US006598727B2

(12) United States Patent
Kasuya

(10) Patent No.: US 6,598,727 B2
(45) Date of Patent: Jul. 29, 2003

(54) AUTOMATIC WIRE ALIGNMENT APPARATUS

(75) Inventor: Kiyoshi Kasuya, Koga (JP)

(73) Assignee: Sanoh Industrial Co., Ltd., Koga (JP)

( * ) Notice: Subject to any disclaimer, the term of this patent is extended or adjusted under 35 U.S.C. 154(b) by 0 days.

(21) Appl. No.: 10/095,474

(22) Filed: Mar. 13, 2002

(65) Prior Publication Data

US 2002/0148632 A1 Oct. 17, 2002

(30) Foreign Application Priority Data

Apr. 13, 2001 (JP) ..... 2001-115059

(51) Int. Cl.[7] ..... B65G 47/14

(52) U.S. Cl. ..... 198/396; 414/415; 414/745.1; 198/186; 198/200

(58) Field of Search ..... 221/186, 187, 221/194, 200, 202, 204, 190; 414/415, 745.1, 745.7, 797.4, 798; 198/396, 752.1, 533, 536, 550.2

(56) References Cited

U.S. PATENT DOCUMENTS 1,553,115 A * 9/1925 Shaw ..... 53/539
1,906,098 A * 4/1933 Pullen et al. ..... 53/236
2,679,334 A * 5/1954 Brown et al. ..... 221/68
2,866,561 A * 12/1958 Groves ..... 414/675
3,307,723 A * 3/1967 Walker et al.
3,400,858 A * 9/1968 Stroheier et al. ..... 221/225
3,549,047 A * 12/1970 Radtke ..... 221/116
4,261,456 A * 4/1981 Scarpa et al. ..... 198/460.1
4,405,060 A * 9/1983 Hsei ..... 221/135
4,466,229 A * 8/1984 Gino ..... 53/559
5,114,015 A * 5/1992 Mussini ..... 209/535

* cited by examiner

*Primary Examiner*—Christopher P. Ellis
*Assistant Examiner*—Richard Ridley
(74) *Attorney, Agent, or Firm*—Varndell & Varndell, PLLC

(57) ABSTRACT

An automatic wire alignment apparatus that can rapidly align wires on an alignment plate is provided. The apparatus includes an elongated alignment plate 10 having parallel grooves 11 for respectively holding a single wire A, a wire supply box 20, vibration generator 30 for vibrating the wire supply box 20. The vibrating causes the wires A in the wire supply box 20 to descend toward the alignment plate 10. A conveyor 40 moves the wire supply box 20, so that the wire supply box 20 is moved relative to the alignment plate 10 in a direction perpendicular to the grooves 11 in the alignment plate 10, and the wires A respectively descend into grooves 11 in the alignment plate 10.

3 Claims, 2 Drawing Sheets

AUTOMATIC WIRE ALIGNMENT APPARATUS

BACKGROUND OF THE INVENTION

1. Field of the Invention

The present invention pertains to an automatic wire alignment apparatus, and more particularly, to an automatic wire alignment apparatus that individually houses wires in grooves formed in an alignment plate.

2. Description of the Related Art

For example, in a heat exchange apparatus or similar apparatus, a multiplicity of wires used to maintain the spaces between coolant pipes formed in a zigzag shape and to increase the heat release surface area are fixed to the coolant pipes using a method such as soldering or welding.

Incidentally, in the heat exchange apparatus described above, the a multiplicity of wires must be aligned parallel to each other when they are placed on the coolant pipes.

As a result, in order to promote ease of assembly, the necessary number of a multiplicity of wires described above are aligned and housed beforehand in grooves formed in an aligning plate, and the a multiplicity of wires aligned in the alignment plate grooves are held in that state by an electromagnet or like means and placed on the coolant pipes formed in a zigzag shape.

However, because the above process of aligning and housing the a multiplicity of wires in the alignment plate grooves is performed manually, it requires considerable time and labor.

SUMMARY OF THE INVENTION

Accordingly, an object of the present invention is to provide an automatic wire alignment apparatus that can rapidly place wires into grooves formed in an alignment plate.

The automatic wire alignment apparatus pertaining to the present invention includes an elongated alignment plate in which is formed parallel grooves each of which houses a wire, a wire supply box that houses a multiplicity of wires, vibration generating means that causes the wire supply box to vibrate, thereby causing the wires located in the wire supply box to descend toward the alignment plate, and conveyance means that moves one or both of the alignment plate and the wire supply box, wherein the wire supply box is moved by the conveyance means relative to the alignment plate in a direction perpendicular to the grooves in the alignment plate, and the wires that are caused to descend from the wire supply box are housed individually in each groove in the alignment plate.

According to the automatic wire alignment apparatus of this invention, the wires contained in the wire supply box are caused to descend via vibration, and the wires that have descended are sequentially housed in grooves formed in an alignment plate due to the movement of the wire supply box relative to the alignment plate.

In the automatic wire alignment apparatus pertaining to the present invention, the side plates of the above wire supply box, which are located across the width of the alignment plate, are placed on the wire supply box in a vertically movable fashion, and each side plate is urged by a spring such that the bottom edge thereof is in continuous contact with the alignment plate.

According to the automatic wire alignment apparatus of this invention, because each side plate of the wire supply box is urged by a spring such that the bottom edge thereof is in continuous contact with the alignment plate, the wires are reliably forced downward by the side plates into the grooves in the alignment plate.

Furthermore, in the automatic wire alignment apparatus pertaining to the present invention, the inner edge surface of each side plate is formed as a slanted surface.

According to this invention, the wires are reliably guided and forced downward into the grooves in the alignment plate by the slanted surface formed on the inner edge surface of each side plate.

DESCRIPTION OF THE PREFERRED EMBODIMENTS

Figure 1:
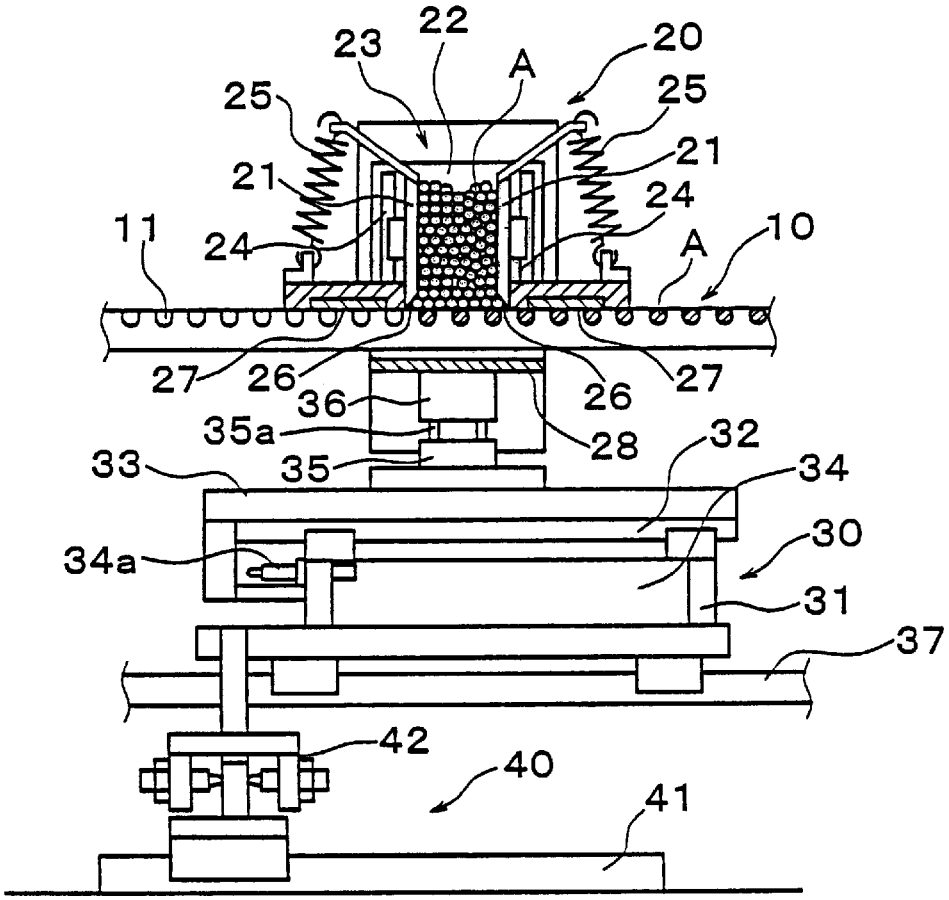
FIG. 1 is a conceptual cross-section showing the automatic wire alignment apparatus pertaining to the present invention.

The automatic wire alignment apparatus pertaining to the present invention will now be explained with reference to an embodiment thereof shown in the drawings.

Figure 2:
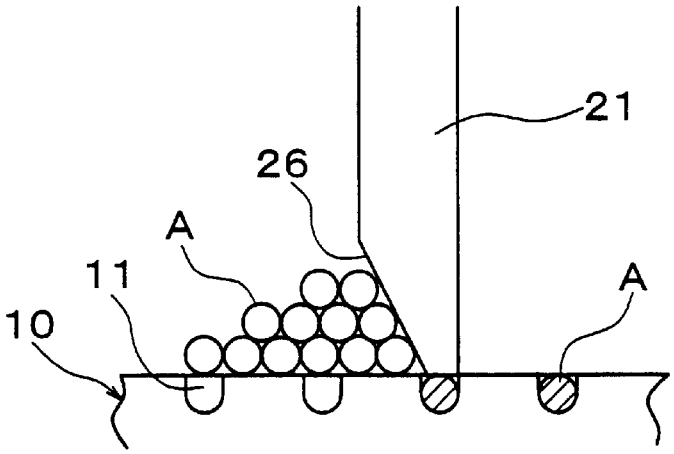
FIG. 2 is a partial cross-section showing an expanded view of the important components of the automatic wire alignment apparatus pertaining to the present invention.

FIG. 1 is a conceptual cross-section of the automatic wire alignment apparatus pertaining to the present invention. FIG. 2 is a partial cross-section showing an expanded view of the important components of the automatic wire alignment apparatus pertaining to the present invention.

The automatic wire alignment apparatus shown in the drawings includes an elongated alignment plate 10 in which are formed parallel grooves 11 each of which houses a wire A, a wire supply box 20 that houses a multiplicity of wires A, vibration generating means 30 that causes the wire supply box 20 to vibrate, thereby causing the wires A located in the wire supply box 20 to descend toward the alignment plate 10, and conveyance means 40 that moves the wire supply box 20.

The wire supply box 20 has a wire housing unit 23 that is formed by side plates (edge plates) 21 and side plates 22 in a rectangular shape as seen from a plan view perspective. The edge plates 21 are each supported by the wire supply box 20 such that they are in slidable contact with one of two rails 24, and are each forced downward by one of two springs 25. The inner surface of the bottom edge of each edge plate 21 is formed as a slanted surface 26, as shown in FIG. 2, and the width of the bottommost edge is set to be identical to the diameter of each wire A. The wire supply box 20 is located such that it straddles the alignment plate 10, and is placed on the top surface of the alignment plate 10 via a low-friction material 27 applied to the bottom surface of the wire supply box 20. Moreover, this wire supply box 20 has a linking plate 28 located between the side plates 22 and below the alignment plate 10 and extending the full distance therebetween.

The vibration generating means 30 is located below the alignment plate 10. This vibration generating means 30 has a vibration platform 33 placed on a rail 32 that is constructed on the top surface of a frame 31, as well as a vibrating cylinder 34 that is located in the center of the frame 31. The plunger 34*a* of the cylinder 34 is located adjacent to the vibration platform 33. Furthermore, an adherence cylinder 35 with a precision regulator is located on the top surface of the vibration platform 33. Adherence means 36 is located on the tips 35*a* of the piston rods 35*a* of this precision regulator-equipped adherence cylinder 35. The adherence means 36 adheres to the linking plate 28 of the wire supply box 20, and keeps the wire supply box 20 in contact with the alignment plate 10 through the application of a constant fixed pressure. The frame 31 is movably located via a rail 37 located parallel to the alignment plate 10.

The conveyance means 40 is located below the vibration generating means 30. The conveyance means 40 comprises a rod-less cylinder 41 and is located such that it can travel along the rail 37 of the vibration generating means 30. This rod-less cylinder 41 is linked to the frame 31 of the vibration generating means 30 via a damper 42.

The automatic wire alignment apparatus having the construction described above is operated as follows.

When the rod-less cylinder 41 of the conveyance means 40 is operated, the frame 31 of the vibration generating means 30 is moved along the rail 37 via the damper 42. The wire supply box 20 is then moved along the alignment plate 10 via the precision regulator-equipped adherence cylinder 35.

During this time, the vibration cylinder 34 of the vibration generating means 30 is operated. The vibration generated by the vibration cylinder 34 is transmitted to the vibration platform 33 via the plunger 34*a*, and is further transmitted to the wire supply box 20 via the precision regulator-equipped adherence cylinder 35.

In other words, in this automatic wire alignment apparatus, the wire supply box 20 is moved along the alignment plate 10 while being vibrated by the rod-less cylinder 41 and the vibration generating means 30.

Therefore, the wires A located in the wire housing unit 23 are in part compelled to descend to the top of the alignment plate 10 due to vibration, and the wires A that have descended are sequentially guided to the grooves 11 in the vibration plate 10 by one of the slanted surfaces 26 of the edge plates 21 and become housed in the grooves 11, as shown in FIG. 2. While this is taking place, if a wire A becomes wedged between the edge of the edge plate 21 and the alignment plate 10, the edge plate 21 escapes upward, the wire A is prevented from being permanently wedged between the edge plate 21 and the alignment plate 10, and the wire A is pressed into the groove 11 by the edge of the edge plate 21.

Because the vibration of the vibration generating means 30 is absorbed by the damper 42, it is not transmitted to the rod-less cylinder 41.

The wires A housed in the grooves 11 in the alignment plate 10 are conveyed to another location either on their own or together with the alignment plate 10, while their alignment is maintained via the use of an electromagnet or like means.

In the above embodiment, the wire supply box 20, the vibration generating means 30 and the like are moved while the alignment plate 10 is kept stationary, but it is acceptable if the alignment plate 10 is moved while the wire supply box 20, the vibration generating means 30 and the like are kept stationary.

Moreover, in the above embodiment, means to move the wire supply box 20, means to cause the wire supply box 20 to vibrate and other components are located below the alignment plate 10, but it is naturally acceptable if such components are located above or beside the wire supply box 20.

In addition, the vibration generating means 30, the conveyance means 40 and the like are not limited to the constructions disclosed in the above embodiment, and other configurations known to persons familiar with the conventional art may be adopted.

As described above, according to the automatic wire alignment apparatus pertaining to the present invention, the wires housed in the wire supply box descend due to vibration, and these wires that have descended are sequentially housed in grooves formed in an alignment plate, due to the movement of the wire supply box relative to the alignment plate.

Furthermore, according to the automatic wire alignment apparatus pertaining to the present invention, because each side plate of the wire supply box is urged by a spring such that the [bottom] edge thereof is in continuous contact with the alignment plate, the wires are reliably forced downward into the grooves in the alignment plate by the edge plates.

Moreover, according to the automatic wire alignment apparatus pertaining to the present invention, the wires are reliably guided and forced downward into the grooves in the alignment plate by the slanted surface formed on the inner edge surface of each side plate.

What is claimed is:

1. An automatic wire alignment apparatus that comprises:

an elongated alignment plate in which are formed parallel grooves each of which houses a single wire;

a wire supply box that houses a multiplicity of wires;

vibration generating means that causes the wire supply box to vibrate, thereby causing the wires located in the wire supply box to descend toward the alignment plate; and conveyance means that moves said wire supply box;

wherein said wire supply box is moved relative to said alignment plate by said conveyance means in a direction perpendicular to the grooves in said alignment plate, and the wires that were caused to descend from said wire supply box are housed individually in each groove in said alignment plate.

2. The automatic wire alignment apparatus according to claim 1, wherein side plates of said wire supply box arranged across a width of said alignment plate are arranged on said wire supply box in a vertically movable fashion, and each said side plate is urged by a spring such that the bottom edge thereof is in continuous contact with said alignment plate.

3. The automatic wire alignment apparatus according to claim 2, wherein the inner edge surface of each said side plate is formed as a slanted surface.

* * * * *